United States Patent [19]

Persson

[11] Patent Number: 4,490,169

[45] Date of Patent: Dec. 25, 1984

[54] METHOD FOR REDUCING ORE

[75] Inventor: John A. Persson, Gibsonia, Pa.

[73] Assignee: Lectromelt Corporation, Pittsburgh, Pa.

[21] Appl. No.: 545,681

[22] Filed: Oct. 26, 1983

Related U.S. Application Data

[60] Continuation-in-part of Ser. No. 281,973, Jul. 10, 1981, abandoned, which is a division of Ser. No. 170,651, Jul. 21, 1980, Pat. No. 4,307,872.

[51] Int. Cl.[3] ..... C22B 4/06

[52] U.S. Cl. ..... 75/11; 420/428; 420/434; 420/581

[58] Field of Search ..... 75/11; 420/428, 434, 420/581

[56] References Cited

U.S. PATENT DOCUMENTS

| | | | |
|---|---|---|---|
| 2,830,889 | 4/1958 | Udy | 75/11 |
| 2,986,459 | 5/1961 | Udy | 420/428 |
| 3,666,438 | 5/1972 | Madronic et al. | 420/434 |
| 3,723,096 | 3/1973 | Parlee et al. | 75/21 |

*Primary Examiner*—M. J. Andrews

*Attorney, Agent, or Firm*—Fred Wiviott

[57] ABSTRACT

Low grade ores, such as low-grade manganese ore, are reduced in an electric smelting furnace having two melting zones divided by a barrier. The ore and a small quantity of carbon are melted in the first zone at a temperature sufficient to reduce the iron oxide contained in the ore to molten iron, leaving molten layers of ore and slag which are richer in manganese than the starting material. The melt and slag are allowed to flow over the barrier to the second zone where a second charge of ore and a greater amount of carbon are deposited. Electrode melting in the second zone is carried out at a higher temperature to reduce the manganese and remaining iron therein to form a high-grade ferromanganese product. The molten products are tapped from the furnace in the respective zones. The method of the present invention may be used with other ores such as low grade chromium ore and the method may also be used for the production of silicomanganese. The method may also be used for a wide variety of other ores where it is desired to remove a first constituent from the starting ore and enrich a second portion of the ore in the same melting furnace.

19 Claims, 2 Drawing Figures

METHOD FOR REDUCING ORE

CROSS-REFERENCE TO RELATED APPLICATIONS

This application is a continuation-in-part application of U.S. patent application Ser. No. 281,973 filed Jul. 10, 1981 now abandoned which in turn was a division of U.S. patent application Ser. No. 170,651, filed Jul. 21, 1980 and now U.S. Pat. No. 4,307,872 issued Dec. 29, 1981.

BACKGROUND OF THE INVENTION

1. Field of the Invention

The present invention relates generally to the art of smelting and more particularly to a method for the sequential reduction of a starting ore material in a melting furnace having two melting zones divided by a barrier.

2. Description of the Prior Art

In the production of steel, various chemical materials are added to the molten ferrous metal to remove undesirable constituents, such as oxygen and sulphur, and to impart one or more desirable properties. These properties may include controlled grain size, improved mechanical strength, and corrosion resistance, among others. Such elements, called addition agents, may include various alloys of iron, termed ferroalloys. Two important addition agents are ferromanganese and ferrochromium which are commonly used to remove and control sulphur and to introduce the elements manganese and chromium into molten steel. Typically, the ferromanganese used as an addition agent has 78–84% manganese, a maximum of about 7.5% carbon, and smaller percentages of other elements. Ferrochromium, when it is used as an addition agent, has similar proportions of chromium and carbon. Ferromanganese and ferrochromium are normally produced by refining ferromanganese or ferrochromium ores having a starting manganese or chromium to iron ratio of about four or five to one.

In one method of producing silicomanganese, another addition agent, standard grade, high carbon ferromanganese is reduced from high-grade ore leaving a gangue-containing slag having up to about 50% manganese oxide therein. After cooling and crushing, this slag may be resmelted in a charge containing a lower grade of manganese, together with silica (which may be a constituent of the ore or may be in the form of quartz), a reductant in the form of carbon, such as coal or coke, and possibly additional fluxes such as lime and silica.

Various types of furnaces, including electric arc furnaces, have been employed in the prior art for such smelting operations. One prior art method of producing ferromanganese by reduction employed pairs of electric arc furnaces. The first furnace was charged with manganese bearing ore along with other materials such as carbon which are required for the reduction to be carried out in the smelting process. Certain of the intermediate products obtained in that furnace were then transported to a second furnace for further reduction to produce ferromanganese or silicomanganese along with other products.

Since the temperatures required for the reduction of ferromanganese and ferrochromium ores are relatively high, usually above at least 1250° C., and since the heat transfer rate between bodies of disparate temperature is directly related to the temperature difference between the two bodies, it is advantageous from an energy conservation standpoint to retain any material being transported from a first stage furnace to a second stage furnace in a high temperature environment. In smelting processes using separate furnaces, the material was cooled and crushed prior to delivery to the second furnace. As a result, considerable heat was lost in the process, requiring the addition of the lost heat in the second furnace. Prior art smelting processes employing two furnaces also have higher manpower requirements. Because of energy, equipment and manpower costs, prior art processes are not normally employed for smelting low-grade ferromanganese or ferrochromium ores which have a manganese or chromium to iron ratio of between four and five to one.

Another disadvantage of prior art furnaces is that the carbon refractory brick used to line the vessel hearth was often absorbed into the product resulting in unpredictable variations in product chemistry as well as erosion of the refractory itself. A method which would overcome this and the above-mentioned disadvantages of the prior art would represent a significant advance in this technology.

OBJECTIONS AND SUMMARY OF THE INVENTION

It is a primary objection of the present invention to provide a new and improved smelting method for the reduction of ores including manganese and chromium ores.

Another object of the present invention is to provide a smelting method for reducing low-grade manganese or chromium ores to produce the corresponding ferromanganese or ferrochromium.

Yet another object of the present invention is to provide a furnace wherein stages of ore reduction may be performed sequentially and/or continuously.

Still another objection of the present invention is to provide a method of producing ferromanganese, ferrochromium or silicomanganese in a single furnace vessel.

A further object of the present invention is to provide a method and apparatus which permits tapping of an iron rich intermediate product and a high-grade final product.

Yet a further object of the present invention is to provide a two-stage smelting system wherein charge quantity, composition and temperature may be separately controlled in each stage.

A still further object of the present invention is to provide a two-stage smelting furnace wherein the profile and integrity of the furnace hearth lining may be maintained.

A different object of the present invention is to provide a lining for a smelting furnace that does not contaminate the melt.

How these and other objects of the invention are accomplished will be described in the following specification taken in conjunction with the drawings. Generally, however, the objects are accomplished by utilizing an electric furnace which includes two zones. The furnace has a floor contoured in such a manner that the bath is divided so that distinct quantities of molten material may be maintained in each zone while, at the same time, slag and molten ore are permitted to freely flow from one zone to the other. A titanium-bearing compound may be applied to the carbon refractory of the furnace so that when the furnace is heated to an elevated temperature, a titanium carbide layer is formed. Such layer is essentially impervious to the otherwise destructive effects of the reduction process being carried out in the furnace.

In accordance with another aspect of the present invention, a charge of low-grade ore, such as ferromanganese or ferrochromium ore, is reduced in the first furnace zone with an amount of carbon which is sufficient for the reduction of a substantial proportion of the iron contained in the charge but which is insufficient for the reduction of the manganese or chromium contained therein. A second charge rich in carbon is provided to the second zone. The manganese or chromium materials transferred from the first zone to the second zone is reduced to high-grade ferromanganese or ferrochromium. Application of current to electrodes in the first zone creates a molten pool of iron which may be recovered, leaving a manganese enriched slag which flows over a furnace divider to the second zone. The temperature within the first zone is selected to cause such iron reduction but to leave the manganese enriched material in a slag state. The enriched slag flowing over the divider and the second charge are heated to a higher temperature resulting in a reduction step which enriches the quality of the ferromanganese or ferrochromium produced therein.

The objects are further accomplished in this invention by a separate technique, i.e. charging manganese ore and a reductant such as carbon into the first zone to produce ferromanganese and a manganese oxide rich slag which is then flowed to a second furnace zone for enriching a different charge applied therein. The different charge in this embodiment can include silicomanganese and a reductant so that the final product produced in this embodiment is high-grade silicomanganese.

Other features of the present invention which aid in satisfying the above-noted objects will be described in the following detailed description of the preferred embodiment and alternate embodiments. These features and other features will become apparent to those skilled in the art after reading the following specification. Those features are deemed to fall within the scope of the invention if they are within the scope of the claims appended hereto.

DESCRIPTION OF THE PREFERRED EMBODIMENT

Figure 1:
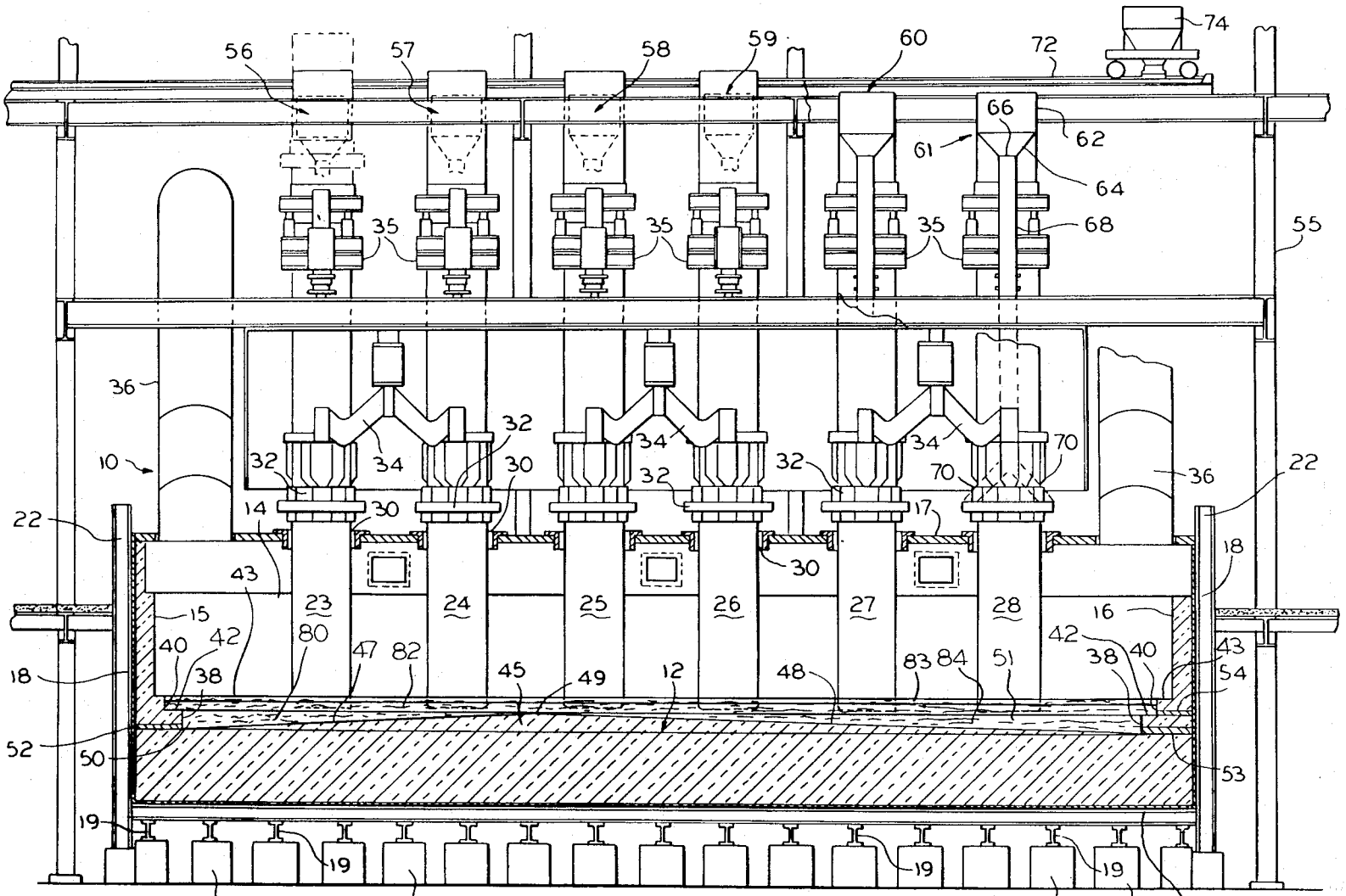
FIG. 1 is a side elevation view, partially in section, of a direct reduction electric furnace employed in carrying out the process of the present invention.
Figure 2:
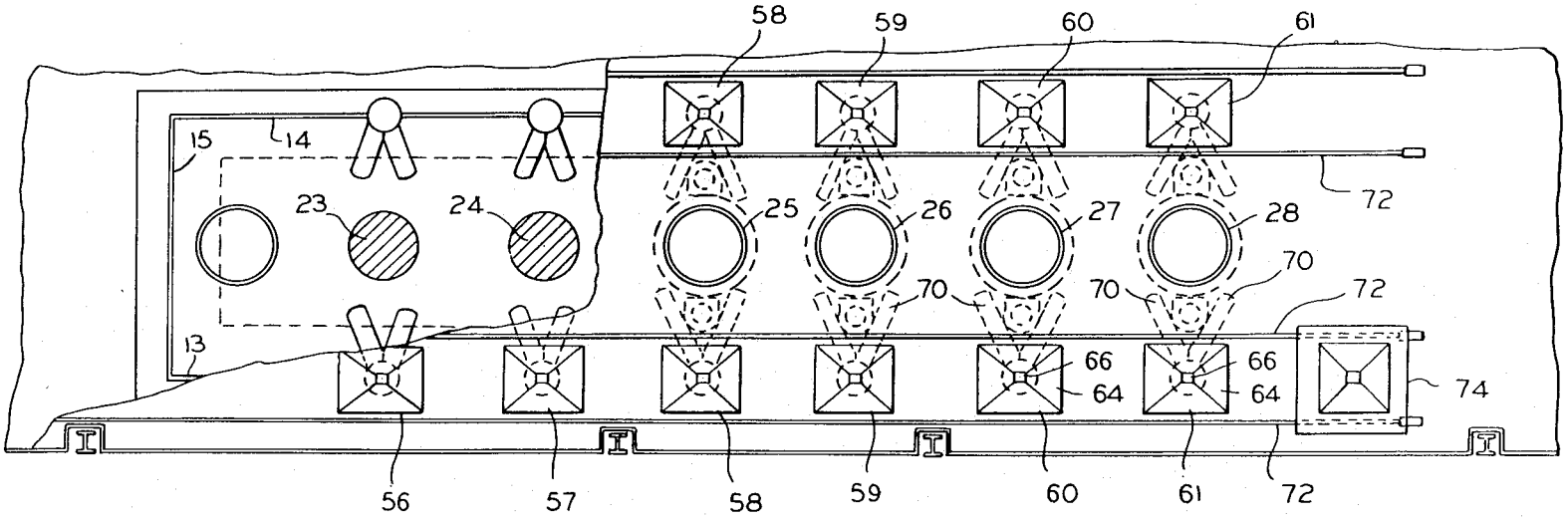
FIG. 2 is a top plan view of a portion of the furnace shown in FIG. 1, with parts broken away.

FIG. 1 shows an electric furnace in which the method according to the invention may be carried out. It should be noted at the outset that the furnace shown in this figure is of the type which includes the electrode tips immersed in the materials to be smelted. Such description is not to be taken as limiting, in that it is only illustrative of the various types of electric furnaces which could be employed in the reduction process of the present invention. For example, electric arc furnaces could also be adapted to carry out the process, in which case the electrodes would be suspended above the materials contained in the furnace with an arc passing therefrom to the material surface. It should also be indicated at the outset that the furnace description itself is in general form, as many of the particular features thereof could be variously embodied as will be appreciated by those skilled in the art.

Furnace 10 may be generally rectangular in plan view and includes a refractory hearth 12, generally vertical refractory walls which include a front wall 13, a rear wall 14, side walls 15 and 16, and a refractory roof 17. A metallic shell 18 may be disposed beneath hearth 12 and around side walls 13–16. In addition, the hearth may be mounted on a suitable support which consists of longitudinally and transversely extending I-beams 19 disposed on footings 20. Lateral support for the side walls 13–16 is provided by vertically extending I-beam members 22.

A plurality of electrodes 23, 24, 25, 26, 27 and 28 extend vertically through spaced apart openings 30 in roof 17. Self-baked carbon electrodes are illustrated, but it should be understood the pre-baked carbon electrodes may also be employed. Electrical energy is supplied to each of the electrodes by a suitable arrangement of contact plates 32 which engage the electrodes above the furnace roof. The contact plates associated with each pair of electrodes are connected by suitable conductors 34 to a source of electrical energy such as a single phase alternately current transformer (not shown). Conventional electrode slipping mechanisms 35 engage each of the electrodes 23–28 for supporting and feeding the electrodes into the furnace 10 as the lower ends thereof are consumed during processing. For a more complete description of one such slipping mechanism, reference may be made to U.S. Pat. No. 4,154,974. Exhaust stacks 36 may be used to connect the furnace 10 to a suitable gas cleaning system (not shown) and for withdrawing and treating gaseous combustion products produced during the smelting operation.

The intersections of the hearth 12 with walls 13–16 are defined by step-like formations consisting of vertical risers 38 and 40 and horizontal surfaces 42 and 43. A refractory separator 45 is also formed in the hearth and is defined by a first planer surface 47 which slopes inwardly and upwardly from the base of riser 38 at the foot of wall 15 to the level of the surface 42 at a point between electrodes 24 and 25. Separator 45 is also defined by a second planer surface 48 which slopes inwardly and upwardly from the base of riser 38 at the foot of wall 16 to the intersection of surface 42 and 47. This defines a divider 49 in hearth 12 and first and second basins 50 and 51 on the opposite sides thereof. Because of the greater power requirements in the second basin, the divider is preferably located such that the ratio of electrodes in the first basin 50 to those in the second basin 51 is approximate or is 1:2.

A first tap hole 52 extends through the end wall 15 to communicate with the first basin 50 at about the intersection of the riser 38 and surface 47. The second and third tap holes 53 and 54 extend through the base of wall 16 to communicate respectively with basin 51 at about the intersection of riser 38 and surface 48 and at the riser 40. Those skilled in the art will appreciate that a removable plug of refractory material is disposed in each tap hole during furnace operation and that a spout (not shown) is provided at the outlet end of each for directing molten material into a suitable ladle or the like.

A framework 55 is disposed adjacent to furnace 10 and extends upwardly along the sides thereof for supporting the slipping mechanisms 35 and a plurality of hoppers 56, 57, 58, 59, 60 and 61 above the furnace roof 17 and on the opposite sides of respective electrodes 23, 24, 25, 26, 27 and 28. Each hopper includes a storage bin 62 having a lower end 64 which is generally funnel shaped and has a central opening 66. A vertically extending discharge conduit 68 is coupled at its upper end to the central opening 66 and at its lower end to a pair of feed pipes 70. Pipes 70 extend into roof ports adjacent to and on opposite sides of the respective electrodes.

The framework 55 also supports two pair of rails 72, one pair of which is disposed above each row of hoppers 56–61. One or more hopper cars 74 are disposed on each pair of rails for being selectively positioned above the respective hoppers and for discharging the required furnace charge into each. It can be seen that hoppers 56 and 57 are positioned to feed charge into the area above basin 50, while hoppers 58–61 are positioned to feed charge into the area above basin 51. A valve or gate (not shown) will be disposed in each of the hopper openings 66 so that the charge material can be fed into the furnace at the command of the furnace operator.

The furnace 10 may be operated in either a batch or continuous mode, but in either case, the contents of the hoppers 56 and 57 will be charged into the area defined by basin 50 while the charge of hoppers 58–61 will be fed into the area defined by basin 51. The electrodes 23–28 will be energized to provide the required smelting heat. The application of the electrical potential effects current flow within the charge thereby supplying the energy in the form of Joule heating.

As indicated previously, the purpose of the reduction in the first basin 51 is to separate a pool of iron 80 from molten ore 82 which floats thereon. Typically, the molten ore 82 will be covered by a slag layer 83. The rate of metal discharge through the tap hole 52 is maintained such that the molten iron pool 80 will substantially fill the basin 50 but will not overflow into basin 51. The molten ore 82 and the slag layer 83 floating on top of the iron will, however, float freely across the divider 49 and into the basin 51. Such flow will create an enriching of the materials in basin 51 inasmuch as iron has been removed therefrom.

Supplying electrical energy to the materials in basin 51 will also form a molten pool, but this time of ferroalloy 84. The rate of discharge from tap hole 53 will also be controlled to maintain the pool of ferroalloy such that it does not overflow the divider 49. In a continuous process, the molten iron will be withdrawn through the tap hole 52 and molten ferroalloy from tap hole 53 at a rate to permit substantially continuous or intermittent feeding of the charged materials. In addition, excess slag may be tapped periodically from tap hole 54.

In addition to the control of temperature, the control of reductant, such as carbon, is also maintained to achieve the desired results of the invention. More specifically, sufficient carbon is added through hoppers 56 and 57 such that substantially only iron will be reduced in basin 50. Conversely, a greater amount of carbon will be added through hoppers 58–61 so that more complete reduction can take place in basin 51 to form the desired high-grade ferroalloy.

By way of general example, and not by way of limitation, it can generally be stated that the reduction of iron oxide in the presence of carbon from low-grade ores takes place at temperatures above about 700° C.; the reduction of chromium oxide in the presence of carbon at around 1250° C.; the reduction of manganese oxide in the presence of carbon at about 1500° C. Also by way of general example, the reaction of silicon dioxide with carbon to form silicon carbide occurs at an even higher temperature, about 1625° C. Using this information, one skilled in the art could readily select the appropriate temperatures for each basin. For example, if either low-grade chromium or manganese ores are to be reduced in the first basin, the temperature would be kept significantly below 1250° C. in basin 50 to remove the iron and allow the transfer of enriched molten material and slag to basin 51. In basin 51, the temperature would be elevated above 1250° C. in the case of chromium containing ores or 1500° C. in the case of manganese containing ores to result in the final chromium or manganese ferroalloy. If silicomanganese is the desired product, basin 50 of the furnace would be heated to about 1500° C. to result in substantial removal of ferromanganese from the starting material leaving a manganese rich slag which is then reduced with quartz and carbon to produce silicomanganese at temperatures above 1625° C. in basin 51.

One example of performing the method of the present invention includes charging a low-grade manganese ore; i.e. having a manganese-to-iron ratio of about four or five to one into the hoppers 56 and 57 along with from about one to about ten weight percent of carbon in the form of coke. In addition, a second charge, i.e. about 70% to 85% of the same low-grade manganese ore is charged into the hoppers 58–61 with about 30 to about 15 weight percent carbon. Flux in the form of lime or silica for chemical balancing may also be charged into each of the hoppers 58–61, depending on the chemistry of the ore being used and the desired properties for the final product.

Table 1 shows a typical low-grade manganese ore as mined and after calcining.

TABLE 1

| | As Mined % | After Calcining % |
|---|---|---|
| Mn | 27 | 39.7 |
| Fe | 6 | 8.8 |
| $SiO_2$ | 10 | 14.7 |
| $Al_2O_3$ | 2.5 | 3.7 |
| CaO | 6 | 8.8 |
| MgO | 7 | 10.3 |
| S | 0.5 | .2 |

Using such starting material hoppers 56 and 57 would contain 1590 kg of calcined ore and 25 kg of coke (76% C). Upon fusion and reduction in basin 50, approximately 85 kg of iron would be produced with an expenditure of energy of approximately 60 kwh from electrodes 23 and 24. The temperature for such reduction would be above 700° C. but significantly below the 1500° C., the temperature at which a substantial reduction of the manganese material would occur.

In addition, 1060 kg of the calcined starting ore and 325 kg of coke (76% C) would be charged into basin 51 from hoppers 58–61. As indicated above, the reduction and smelting of the carbon poor charge in basin 50 will cause a separation of pig iron from the molten ore 82 and the slag floating thereon in layer 83. These materials will layer in accordance with their specific gravity causing the molten pig iron 80 to collect in the basin 50 with the molten ore 82 disposed thereabove and covered by the slag layer 83. The rate of metal removed from tap hole 52 and the furnace dimensions will be such that a pool of iron 80 will substantially fill the basin 50 but will not overflow the divider 49, while the molten ore 82 and slag 83 may flow over the divider 49 and toward basin 51.

The initial charge of manganese ore will contain about 39.7% manganese and about 8.8% iron by weight so that of the 1590 kg charge, about 630 kg of manganese will be present compared to about 140 kg of iron. This is a manganese-to-iron ratio of 4.5:1. The withdrawal of about 85 kg of iron from the molten ore in basin 50 will leave about 55 kg of iron in the layer of molten ore 82 and slag 83. The charge of 1060 kg of the same ore from hoppers 56 to 61 will provide about 92 kg of iron and about 420 kg of manganese. The addition of the manganese rich melt in the layer 82 and the manganese dissolved in the slag 83 will provide a total of about 1050 kg of manganese available to the basin 51 and only about 147 kg of iron. Thus, the manganese-to-iron ratio in basin 51 will be about 7.8:1. This is equivalent to that of a high-grade ore compared to the low-grade starting material.

The yield of the furnace in the above example will be about 1000 kg of ferromanganese, consisting of 78–80% manganese. This can typically be accomplished with the expenditure of an additional 2200 kwh from electrodes 25–28. This expenditure of energy will create temperatures of around 1500° C., i.e. the temperatures required for substantial reduction of the manganese ferroalloy.

The slag which is tapped from the furnace through tap hole 54 in the above example would have the following partial compositions:

| | |
|---|---|
| Fe | 0.7% |
| Mn | 15 |
| CaO | 19 |
| MgO | 18 |
| $SiO_2$ | 31 |

However, the actual slag composition could vary over a wide range depending upon the grade of ore used. The manganese content of the slag, in particular, could vary from about 3% to 40%.

When the furnace 10 is employed in the manufacture of ferrochromium, the charge delivered to basin 50 includes low-grade chromium ore, i.e. an ore having a chromium-to-iron ratio of about 5:1 and a combined chromium-iron content of about 44.8%. A small portion of reductant, which may comprise coke, cool, lignite or charcoal is also used with this portion of the charge as referred to above. Preferably, the charge will contain about 51% chromium and about 13.5% reductant with the two constituting at least 39% of the total furnace charge. However, the proportion of chromium bearing charge can be increased for power balancing purposes. The basin 51 is charged with a carbon rich charge of ore and carbon, for example, not more than 49.2% of the total chromium charge and about 86.5% of the total reductant carbon. Flux in the form of limestone, lime and silica for chemical balance may also be charged into basin 51.

As in the production of ferromanganese, iron separates from the materials added to basin 50 and collects therein. The slag, which has been enriched in chromium, floats over the divider 49 into basin 51 for enriching the materials added there. In this process, about 20% of the metal output is in the form of iron tapped from basin 50 and about 80% is in the form of ferrochromium containing about 70% chromium which is tapped from basin 50. This is considered to be a high-grade chromium ferroalloy compared to that normally obtained from the low-grade starting ore.

Yet another example of the principles of the present invention can be provided by reference to the production of silicomanganese. In this process, the starting material is a high-grade manganese ore, i.e. an ore having a manganese-to-iron ratio of about 7:1. This is charged into basin 50. Basin 51 is charged with a lower grade of ferromanganese ore, i.e. having a manganese-to-iron ratio of about 5:1 together with silica which can be a constituent of the ore or can be quartz. A reductant such as carbon in the form of coal or coke and possibly additional fluxes, such as lime, are used. As the ore melts in basin 50, standard grade ferromanganese is formed along with a covering slag layer which contains about 50% manganese oxide. That slag is free to flow over divider 49 into basin 51 while the iron may be removed through tap hole 52. The manganese oxide in the slag and the manganese ore added in basin 51 are reduced by the carbon to produce silicomanganese which is then withdrawn through tap hole 53. The latter would be done at a substantially higher temperature (for example, above 1625° C.) than that employed in the original reduction step to produce ferromanganese. The proportions of ore, slag and quartz in basin 51 may vary over a relatively wide range which could be readily determined by one skilled in the art after reading and understanding the principles of the present invention.

As those skilled in the art will appreciate, the lining of smelting furnaces typically comprise carbon blocks. To prevent the absorption of carbon by the iron or ferromanganese, the lining in the present invention is stablized by the addition of titania in the charge upon initial startup of the furnace. This may take the form of ilmenite or other titania bearing ores. As the furnace is initally brought up to temperature, stable titanium carbides are formed on the lining surface to provide a substantially impervious interface with the metal being treated in the furnace. In this manner, the lining can be retained in its original shape through a substantial number of operating cycles.

While the present invention has been described in connection with only a few embodiments, the principles are readily adaptable to a wide variety of ores. For example, free energy diagrams are available in the art which show the reduction temperatures of various ore compositions. Therefore, the invention may be applied to the reduction of such metals as copper, aluminum, titanium, zinc, magnesium and the like. Reduction of low-grade material is accomplished by removing an undesired metal using a reductant amount which is sufficient only for the reduction of that metal. An enriched slag and molten layer form which is used to enrich another quantity of the same starting ore which in turn is reduced with a higher quantity of the reductant to form the desired product. Therefore, the invention is not to be limited to the illustrations and examples provided above but is to be limited only by the scope of the claims which follow.

I claim:

1. A method of preparing a high-grade alloy from a low-grade ore, said low-grade ore comprising oxides of iron and a certain metal and said high-grade alloy comprising iron and a percentage of said metal which is greater than that present in said low-grade ore, said method comprising the steps of:

providing an electric furnace having a hearth, said hearth being divided by divider means into first and second basins, said furnace further comprising electrodes in said first and second basins;

feeding a first charge consisting of a major portion of said low-grade ore and a minor portion of a reductant into said first basin;

applying an electric current to the charge in said first basin to reduce the iron oxide in said low-grade ore to form molten iron in said first basin and to form an enriched layer of molten charge and slag thereabove, said enriched layer having a higher percentage of said certain metal than said low-grade ore;

allowing said layer to flow to said second basin;

feeding a second charge of said low-grade ore and a greater portion of reductant into said second basin;

applying an electric current to the materials within said second basin to form said high-grade alloy; and controlling the temperature and the amount of reductant in said first and second basins to cause substantially only iron to be reduced in said first basin and to form said high-grade alloy in said second basin.

2. The method set forth in claim 1 comprising the further steps of continuously feeding said charges to said first and second basins and tapping iron from said first basin and said high-grade alloy from said second basin.

3. The method set forth in claim 1 wherein said low-grade ore is a low-grade manganese ore and wherein said high-grade alloy is ferromanganese.

4. The method set forth in claim 3 wherein the ratio of manganese to iron in said low-grade ore is about 4–5:1 and the ratio of manganese to iron in said ferromanganese is 7–8:1.

5. The method set forth in claim 1 wherein said first furnace charge contains about 90 to 99% ore and about 1 to about 10% carbon as said reductant and said second furnace charge consists of about 70 to 85% ore and about 15 to about 30% carbon as said reductant.

6. The method set forth in claim 3 wherein said first furnace charge consists primarily of low-grade manganese ore having a manganese-to-iron ratio of about 4–5:1 and a small quantity of carbon and said second furnace charge consists of a major portion of said low-grade manganese ore and a minor portion of carbon, the proportion of carbon in said second furnace charge being about 10 to 20 times greater than the percentage of carbon in said first furnace charge.

7. The method set forth in claim 6 wherein the first charge is about 90 to 99% ore and about 10–1% carbon and said second furnace charge is about 70–85% ore and about 30–15% carbon.

8. The method set forth in claim 1 wherein said divider is formed of a carbon containing material and wherein a titanium containing material is added to said furnace charge for forming titanium carbide on the surface of said divider.

9. The method set forth in claim 1 wherein said low-grade ore is a chromium ore and said high-grade alloy is ferrochromium.

10. The method set forth in claim 9 wherein the ratio of chromium to iron in said low-grade ore is about 4–5:1 and the ratio of chromium to iron in said ferrochromium tapped from said second basin is about 7–8:1.

11. A method for producing high-grade ferromanganese from a low-grade manganese ore comprising the steps of:

providing an electric arc furnace including a hearth having a divider therein to form two basins; said furnace having electrodes within said basins to apply an electric current and to heat materials contained therein;

feeding a first charge consisting of a major portion of said low-grade manganese ore and a minor portion of carbon into said first basin;

applying a current to said electrodes to melt said charge and to reduce the iron contained therein to form molten iron, the amount of carbon used in said first charge and the temperature within said first basin being sufficient to remove a substantial amount of the iron from said first charge without removing a substantial amount of the manganese therefrom;

said feeding and applying steps being continued so that a pool of molten iron is formed in said first basin and a layer of molten ore and slag ore is formed thereabove, said molten pool filling said basin to a level adjacent to but below the height of said divider whereby said molten iron is not allowed to flow to said second basin but said molten ore and slag may freely flow thereto;

feeding a second charge of said low-grade manganese ore and a greater proportion of carbon into said second basin whereby the materials contained therein include such second charge together with the manganese enriched molten layer and slag produced in said first basin;

applying an electric current to the electrodes within said second basin to form a molten pool of ferromanganese therein, the amount of carbon and the temperature applied in said second zone being sufficient to produce said ferromanganese.

12. The method set forth in claim 11 wherein said charging and applying steps are performed continuously and wherein molten iron is tapped from said first basin and molten ferromanganese is tapped from said second basin.

13. The method set forth in claim 11 wherein the ratio of manganese to iron in said low-grade ore is about 4–5:1 and the ratio of manganese to iron in said ferromanganese is about 7–8:1.

14. A method for producing high-grade ferrochromium from a low-grade chromium ore comprising the steps of:

providing an electric arc furnace including a hearth having a divider therein to form two basins; said furnace having electrodes within said basins to apply an electric current and to heat materials contained therein;

feeding a first charge consisting of a major portion of said low-grade chromium ore and a minor portion of carbon into said first basin;

applying a current to said electrodes to melt said charge and to reduce the iron contained therein to form molten iron, the amount of carbon used in said first charge and the temperature within said first basin being sufficient to remove a substantial amount of the iron from said first charge without removing a substantial amount of the chromium therefrom;

said feeding and applying steps being continued so that a pool of molten iron is formed in said first basin and a layer of molten ore and slag ore is formed thereabove, said molten pool filling said basin to a level adjacent to but below the height of said divider whereby said molten iron is not allowed to flow to said second basin but said molten ore and slag may freely flow thereto;

feeding a second charge of said low-grade chromium ore and a greater proportion of carbon into said second basin whereby the materials contained therein include such second charge together with the chromium enriched molten layer and slag produced in said first basin;

applying an electric current to the electrodes within said second basin to form a molten pool of ferrochromium therein, the amount of carbon and the temperature applied in said second zone being sufficient to produce said ferrochromium.

15. The method set forth in claim 14 wherein said charging and applying steps are performed continuously and wherein molten iron is tapped from said first basin and molten ferrochromium is tapped from said second basin.

16. The method set forth in claim 14 wherein the ratio of chromium to iron in said low-grade chromium ore is about 4–5:1 and the ratio of chromium to iron in said ferrochromium is about 7–8:1.

17. A method for producing silicomanganese comprising the steps of:

providing an electric furnace having a hearth, said hearth including dividing means to provide first and second basins within said hearth, electrodes being provided in said first and second basins for applying an electric current to heat the materials contained therein;

feeding a first charge of high-grade manganese ore into said first basin together with an amount of carbon sufficient to reduce a substantial amount of the iron contained in said ore and a portion of the manganese contained therein;

applying a charge to the electrodes in said first basin to generate a temperature therein sufficient to melt said ore and to reduce ferromanganese therefrom, producing a manganese rich layer of molten charge and slag thereabove, said ferromanganese forming a pool substantially filling said first basin;

allowing said molten charge and slag to flow from said first basin to said second basin;

feeding a second charge of lower-grade manganese containing ore into said second basin together with silica and carbon, the ratio of manganese-to-iron of said second charge ore being less than said ratio in said first charge;

applying an electric current to the electrodes in said second basin to melt said charge and to form a molten pool of silicomanganese in said second basin.

18. The method set forth in claim 17 wherein the manganese-to-iron ratio of said high-grade manganese ore is about 7:1 and the ratio of manganese-to-iron in said lower-grade manganese ore is about 5:1.

19. The method set forth in claim 17 wherein the temperature within said second basin is higher than the temperature in said first basin.

* * * * *